US007160162B2

(12) United States Patent
Nakata et al.

(10) Patent No.: US 7,160,162 B2
(45) Date of Patent: Jan. 9, 2007

(54) EXHAUST SYSTEM FOR INTERNAL COMBUSTION ENGINE OF OUTBOARD MOTOR

(75) Inventors: Jun Nakata, Shizuoka-ken (JP); Hideaki Masui, Shizuoka-ken (JP)

(73) Assignee: Yamaha Marine Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 11/134,101

(22) Filed: May 20, 2005

(65) Prior Publication Data

US 2005/0260900 A1 Nov. 24, 2005

(30) Foreign Application Priority Data

May 20, 2004 (JP) ..... 2004-150912

(51) Int. Cl.
*F01N 7/00* (2006.01)

(52) U.S. Cl. ..... 440/89 J

(58) Field of Classification Search ..... 440/89 G, 440/89 H, 89 J
See application file for complete search history.

(56) References Cited

U.S. PATENT DOCUMENTS 5,232,387 A * 8/1993 Sumigawa ..... 440/89 D
5,326,295 A 7/1994 Nakayama
5,954,022 A * 9/1999 Katayama et al. ..... 123/195 P
6,394,057 B1 * 5/2002 Fukuoka et al. ..... 123/195 P

* cited by examiner

*Primary Examiner*—Stephen Avila
(74) *Attorney, Agent, or Firm*—Knobbe, Martens, Olson & Bear, LLP

(57) ABSTRACT

An exhaust system that reduces noise generated by exhaust gases is provided. The exhaust system includes a drive unit that supports an internal combustion engine. An exhaust guide forms an upper portion of the case. An oil pan is attached to a lower surface of the exhaust guide. An exhaust passage leads exhaust gas of the internal combustion engine from an upper side to a lower side of the case, and discharges the exhaust gas from the lower side into a body of water. A branch passage extends from the exhaust passage at an intermediate portion thereof. The branch passage is configured for discharging the exhaust gas inside the exhaust passage into ambient air, and includes an expansion chamber at its intermediate portion. The expansion chamber is partially defined by the exhaust guide and partially defined by the oil pan.

10 Claims, 10 Drawing Sheets

EXHAUST SYSTEM FOR INTERNAL COMBUSTION ENGINE OF OUTBOARD MOTOR

RELATED APPLICATION

The present application claims priority to Japanese patent application Serial No. 2004-150912, filed on May 20, 2004, the entire content of which is hereby expressly incorporated by reference.

BACKGROUND OF THE INVENTION

1. Field of the Invention

The present invention relates to an exhaust system for an internal combustion engine of an outboard motor, in which an exhaust passage for leading exhaust gas from the internal combustion engine is formed in a case of the motor.

2. Description of the Related Art

Japanese Patent Publication No. JP-A-Hei 6-66125 describes one type of conventional outboard motor. The outboard motor according to this publication includes a drive unit supported by a hull, a propeller supported by the lower end of the case to be immersed in the water, and an internal combustion engine supported on the upper surface of the drive unit. The drive unit includes an exhaust guide constituting its upper portion, an upper case attached to the lower surface of the exhaust guide, and a lower case attached to the lower surface of the upper case. The lower case is disposed so as to be immersed in water. The propeller is supported by the lower case.

The drive unit is formed with an exhaust passage for leading exhaust gas from the internal combustion engine from an upper side to a lower side of the case and discharging the exhaust gas from the lower side into the water. The drive unit is also formed with a branch passage branching from the exhaust passage at an intermediate portion thereof for discharging the exhaust gas inside the exhaust passage directly out into ambient air. Respective intermediate portions of the exhaust passage and the branch passage are formed with an expansion chamber.

When the internal combustion engine is driven, the propeller is driven in conjunction therewith to propel the boat. At this time, most of the exhaust gas from the internal combustion engine is discharged into the water through the exhaust passage. A portion of the exhaust gas passes through the branch passage from the intermediate portion of the exhaust passage to be directly discharged into the ambient air. When the internal combustion engine is idling, the exhaust gas is small in amount and low in pressure. Therefore, when the exhaust gas reaches the intermediate portion of the exhaust pipe, most of it passes through the branch passage to be directly discharged into the ambient air. On this occasion, the exhaust gas passes through the expansion chambers and the exhaust noise can be thereby reduced.

However, in the conventional outboard motor described above, the expansion chambers are both formed in the upper case. Preferably, the capacities of the expansion chambers are as large as possible in order to sufficiently reduce the exhaust noise. On the other hand, the case, including the upper case, is preferably small so as to facilitate handling of the outboard motor.

Therefore, it is difficult to provide sufficiently large capacities for the expansion chambers. Under such conditions, especially when the internal combustion engine is idling, when most of the exhaust gas passes through the branch passage to be directly discharged into the ambient air, the exhaust noise may not be reduced below a desired level.

Furthermore, when the internal combustion engine is started, only a small amount of exhaust gas passes through the exhaust passage, at a low speed. Thus, a negative pressure may occur in the exhaust passage due to exhaust pulsation at the start, which is likely to cause the water to be drawn into at least the drive unit through the exhaust passage.

The internal combustion engine may sometimes rotate in reverse immediately after it is stopped. In such situations, a negative pressure may occur in the exhaust passage due to the reverse rotation. This negative pressure is likely to cause the water to be drawn into at least the drive unit through the exhaust passage.

SUMMARY OF THE INVENTION

In accordance with one aspect of the present invention, an exhaust system for an internal combustion engine of an outboard motor is provided that comprises a drive unit configured to be supported by a hull of a watercraft; and an internal combustion engine supported on an upper surface of the case. The case comprises an exhaust guide forming an upper portion of the case. An oil pan is attached to a lower surface of the exhaust guide. An exhaust passage in the case is configured for leading exhaust gas of the internal combustion engine from an upper side to a lower side of the case, and for discharging the exhaust gas from the lower side into a body of water. A branch passage extends from the exhaust passage at an intermediate portion thereof. The branch passage is configured for discharging the exhaust gas inside the exhaust passage to ambient air. The branch passage is formed with an expansion chamber at its intermediate portion. The expansion chamber is at least partially defined by the exhaust guide and at least partially defined by the oil pan.

Thus, the expansion chamber is defined not only in the oil pan, but also in the exhaust guide. Therefore, the capacity of the expansion chamber can be increased as compared to prior outboard motors, in which the expansion chamber is formed only in an upper case, which is a counterpart of the oil pan. As a result, the exhaust noise generated when the internal combustion engine is idling can be significantly reduced in comparison to prior outboard motors.

In one mode, the expansion chamber is formed between respective mating surfaces of the exhaust guide and the oil pan. Therefore, specifically when the exhaust guide and the oil pan are made by casting, dies can be easily removed in forming the expansion chamber. As a result, the branch passage can be formed easily and inexpensively.

Another mode of the present exhaust system comprises the system as described above, and further including an exhaust pipe. An upstream end of the exhaust pipe is located in a lower region of the expansion chamber. The exhaust pipe passes through an upper region of the expansion chamber and has a downstream end opening outwardly therefrom. Exhaust gas from the exhaust passage flows into the expansion chamber from the upper region, then to the lower region, and then into the exhaust pipe from the upstream end to the downstream end. The configuration of the exhaust pipe increases the length of the path of travel for the exhaust gases, thereby further reducing exhaust noise.

Another mode of the present exhaust system comprises the system as described above, in which a bypass is formed in the exhaust guide. The bypass allows a portion of the exhaust passage upstream from the branch passage to communicate with the expansion chamber, thereby alleviating the tendency of water to be drawn into the drive unit through the exhaust passage. When the internal combustion engine is started or reversed, the pressure in the upstream-side passage of the exhaust passage tends to be negative (relative to ambient pressure). When the pressure in the upstream-side passage is about to become negative, however, the upstream-side passage draws in the ambient air through the branch passage and air (exhaust gas) through the bypass from the large-volume expansion chamber of the branch passage. Therefore, the pressure in the exhaust passage is less likely to become excessively negative when the internal combustion engine is started or runs backwards. As a result, water is less likely to be drawn into the drive unit through the exhaust passage.

BRIEF DESCRIPTION OF THE DRAWINGS

The preferred embodiments of the present exhaust system, illustrating its features, will now be discussed in detail. These embodiments depict the novel and non-obvious exhaust system shown in the accompanying drawings, which are for illustrative purposes only. These drawings include the following figures, in which like numerals indicate like parts.

DETAILED DESCRIPTION OF THE PREFERRED EMBODIMENTS

Figure 1:
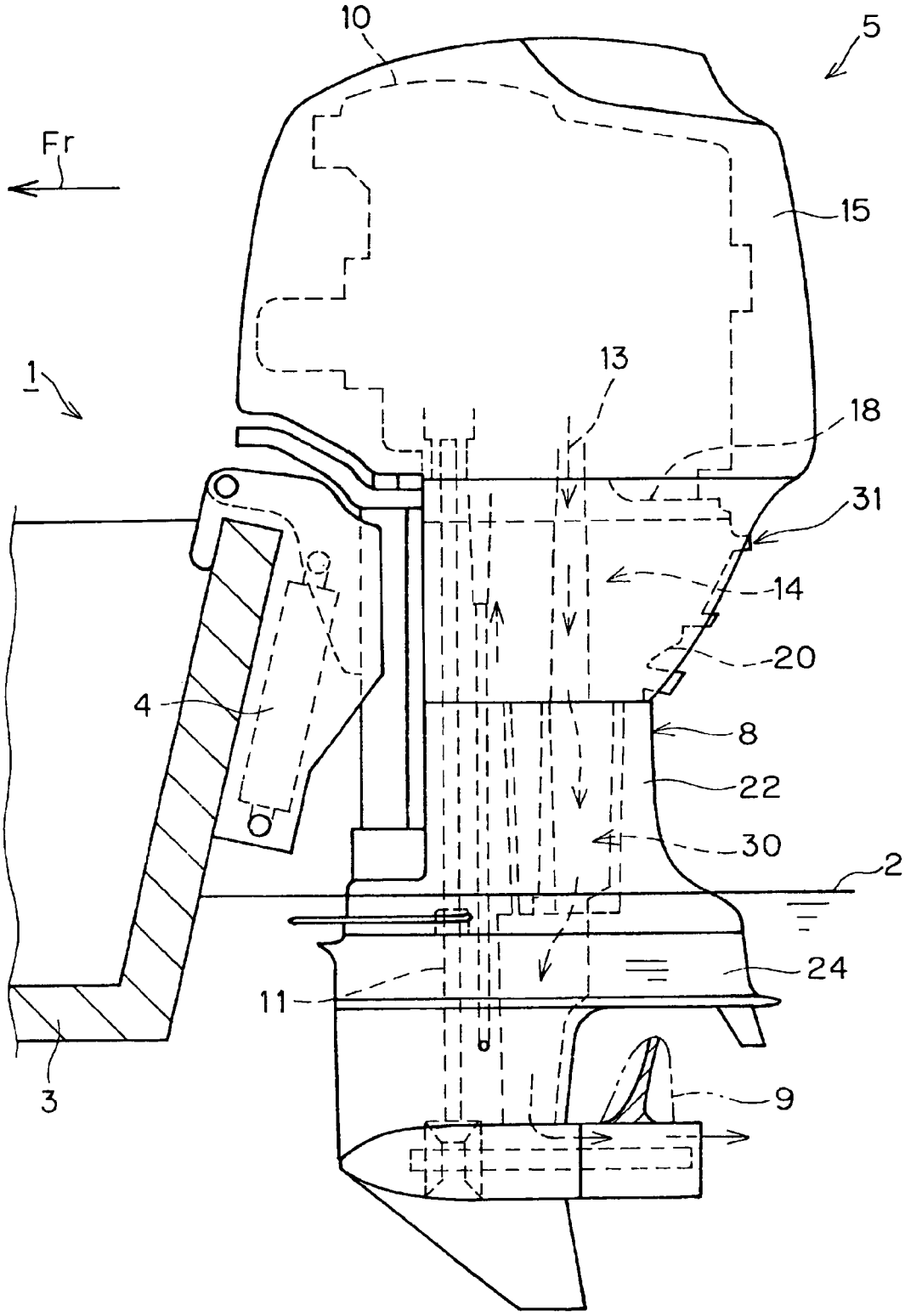
FIG. 1 is an overall side elevational view of an outboard motor with several internal components thereof shown in phantom.

With reference to FIG. 1, a boat 1 includes a hull 3 capable of floating on the surface of a body of water 2. A clamp bracket 4 supports an outboard motor 5 at the rear end of the hull 3. The arrow Fr in the figures indicates the forward direction of travel for the boat 1.

The outboard motor 5 includes a drive unit or case 8 that extend generally vertically. The bracket 4 pivotally supports an upper portion of the case 8, while a lower portion is immersed in the water 2. The lower end of the case 8 supports and journals a propeller 9. The upper surface of the case 8 supports an internal combustion engine 10. A power transmission device 11 housed in the case 8 operatively connects the propeller 9 to a crankshaft of the internal combustion engine 10. An intake system sends a mixture of ambient air and fuel to the internal combustion engine 10. An exhaust system 14 leads exhaust gas 13 from the internal combustion engine 10 into the ambient air and into the water 2. A cowling 15 covers the internal combustion engine 10 and the intake system.

Figure 2:
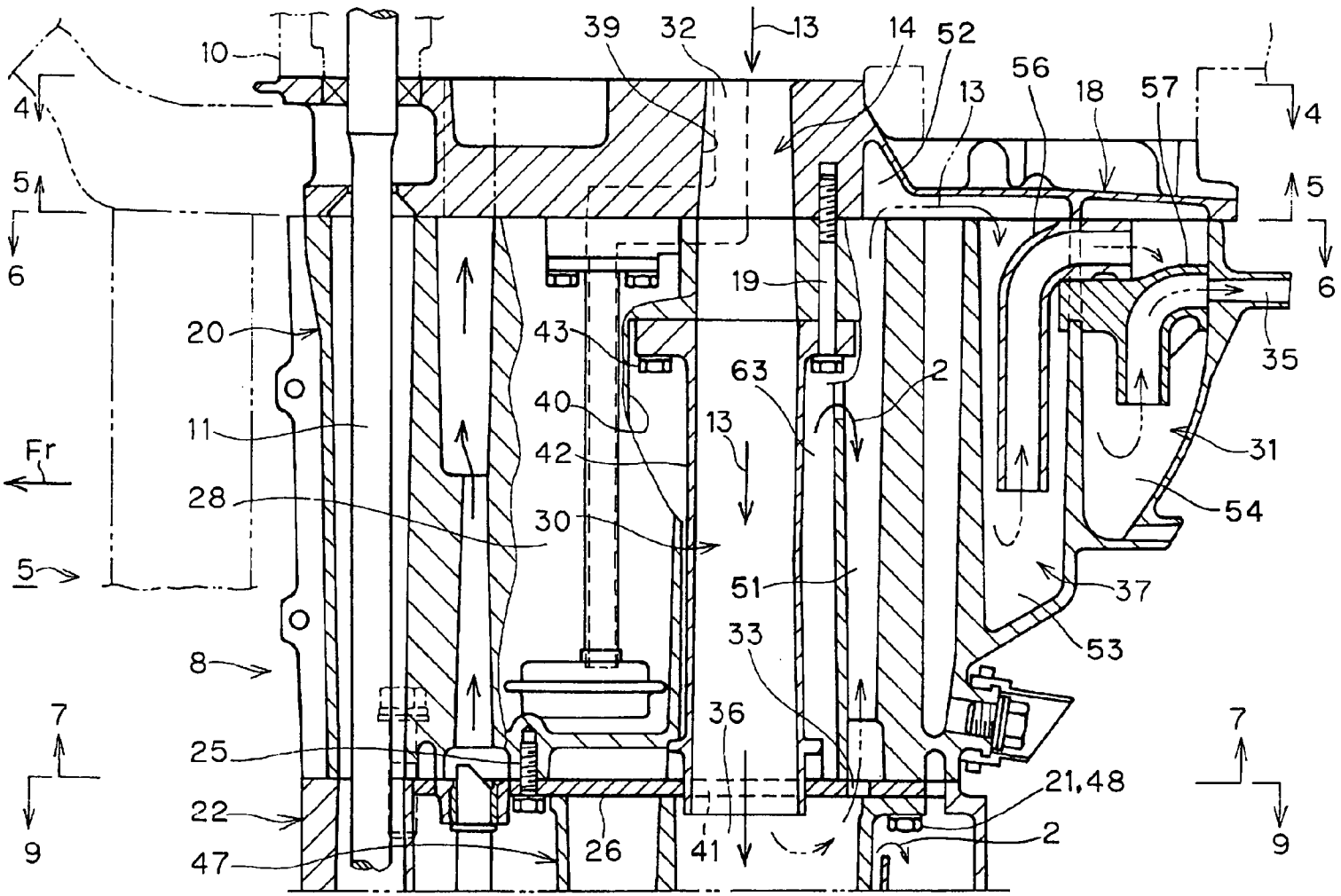
FIG. 2 is a cross-sectional detail view of an exhaust guide and a portion of an upper case of the outboard motor of FIG. 1.
Figure 3:
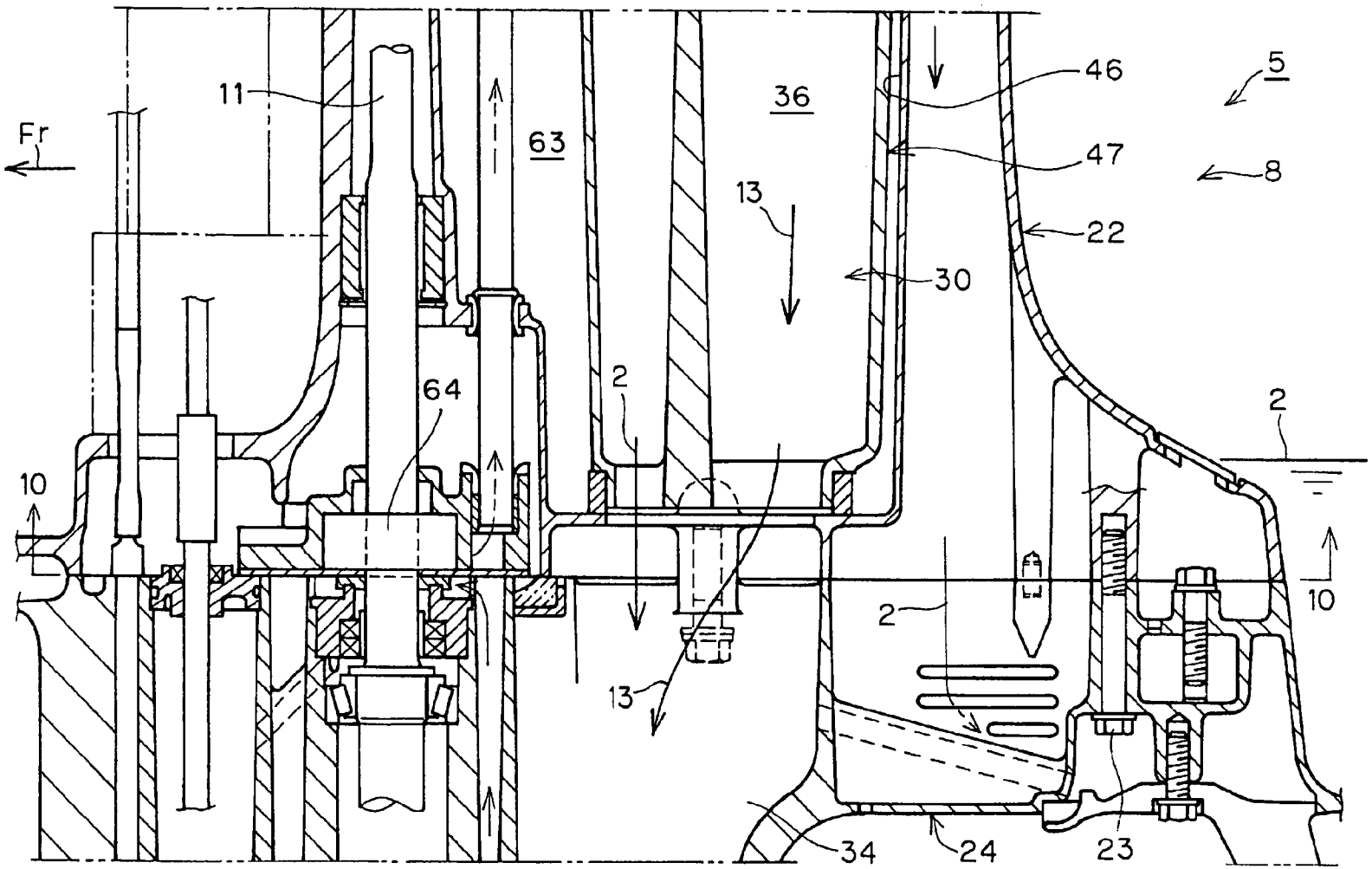
FIG. 3 is a cross-sectional detail view of a lower portion of the upper case of FIG. 2 and a portion of a lower case of the outboard motor of FIG. 1.

The case 8 is preferably made of an appropriate material having the desired properties of strength, heat resistance, corrosion resistance and light weight. For example, a preferred material is cast aluminum. With reference to FIG. 2, the case 8 includes an exhaust guide 18 forming the upper portion of the case 8 for supporting the internal combustion engine 10 on its upper surface. A fastener 19 secures an oil pan 20 to the lower surface of the exhaust guide 18. A fastener 21 secures an upper case 22 to the lower surface of the oil pan 20. With reference to FIG. 3, a lower case 24, which is attached to the lower surface of the upper case 22 by a fastener 23, supports the propeller 9. With reference to FIG. 2, a partition plate 26, which is interposed between the oil pan 20 and the upper case 22, is attached to the lower surface of the oil pan 20 by a fastener 25.

With continued reference to FIG. 2, a reservoir chamber 28 formed within the oil pan 20 stores lubricant. An oil pump (not shown) operates in conjunction with the internal combustion engine 10 to supply the lubricant to various portions of the engine. The lubricant returns to the reservoir chamber 28 after lubricating the respective portions.

With reference to FIGS. 2 and 3, the case 8 includes an exhaust system 14. An exhaust passage 30 leads exhaust gases 13 of the internal combustion engine 10 from an upper side to a lower side of the case 8, and discharges the exhaust gases 13 from the lower side into the water 2. The case also includes a branch passage 31 that extends from an intermediate portion of the exhaust passage 30. The branch passage 31 directly discharges at least a portion of the exhaust gas 13 (indicated by the chain of double-dashed lines in FIGS. 2 and 6) inside the exhaust passage 30 into the ambient air.

With reference to FIGS. 2 and 3, an intermediate portion of the exhaust passage 30, between the upstream-side passage 32 and downstream-side passage 34, includes an expansion chamber 36. Similarly, with reference to FIG. 2, an intermediate portion of the branch passage 31, between the upstream-side passage 33 and downstream-side passage 35, includes an expansion chamber 37. At least some portions of each expansion chamber 36, 37 are larger in cross-section than the upstream-side passages 32, 33, respectively.

Figure 7:
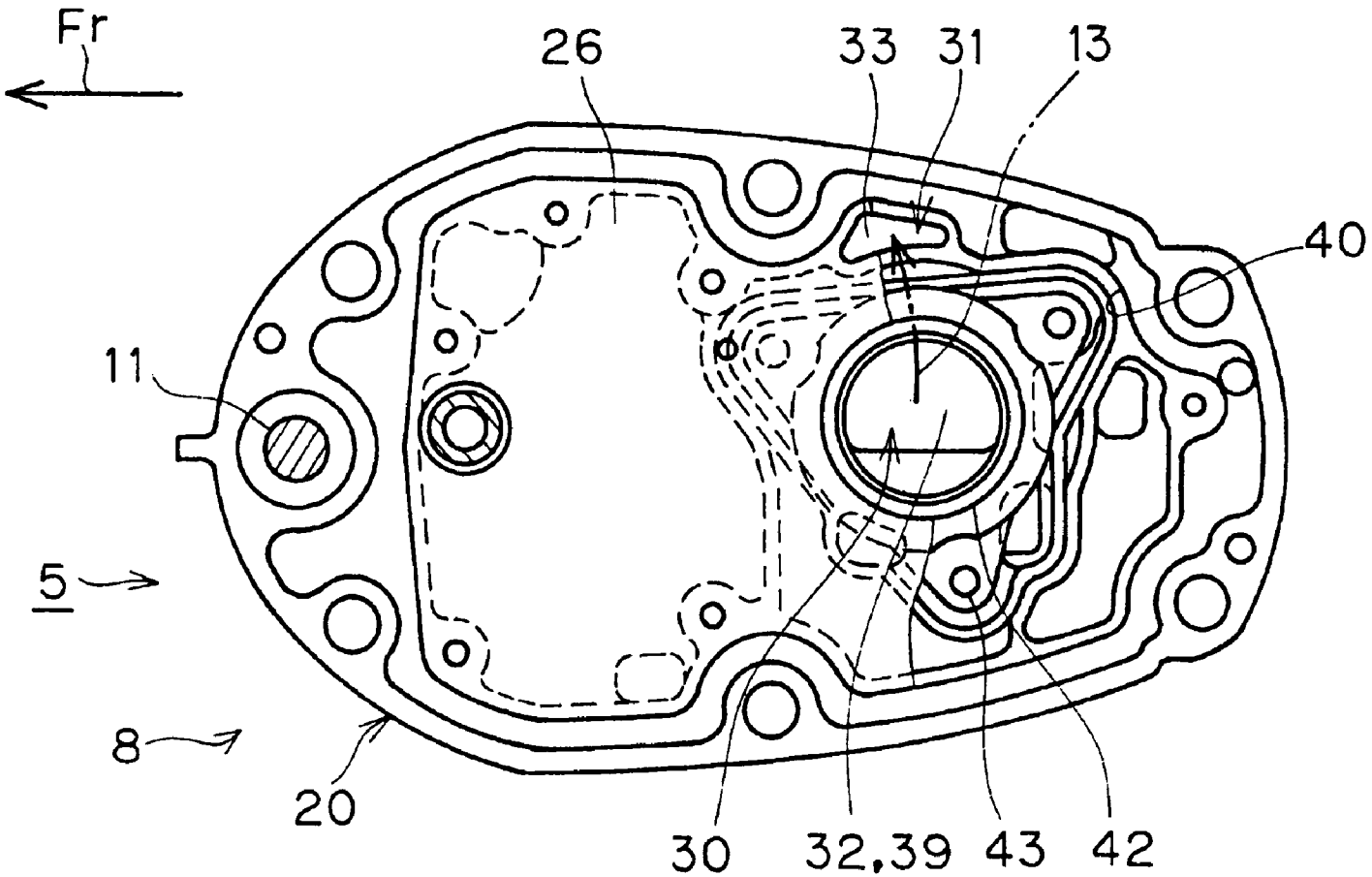
FIG. 7 is a cross-sectional view of a portion of the outboard motor taken along the line 7—7 of FIG. 2.
Figure 8:
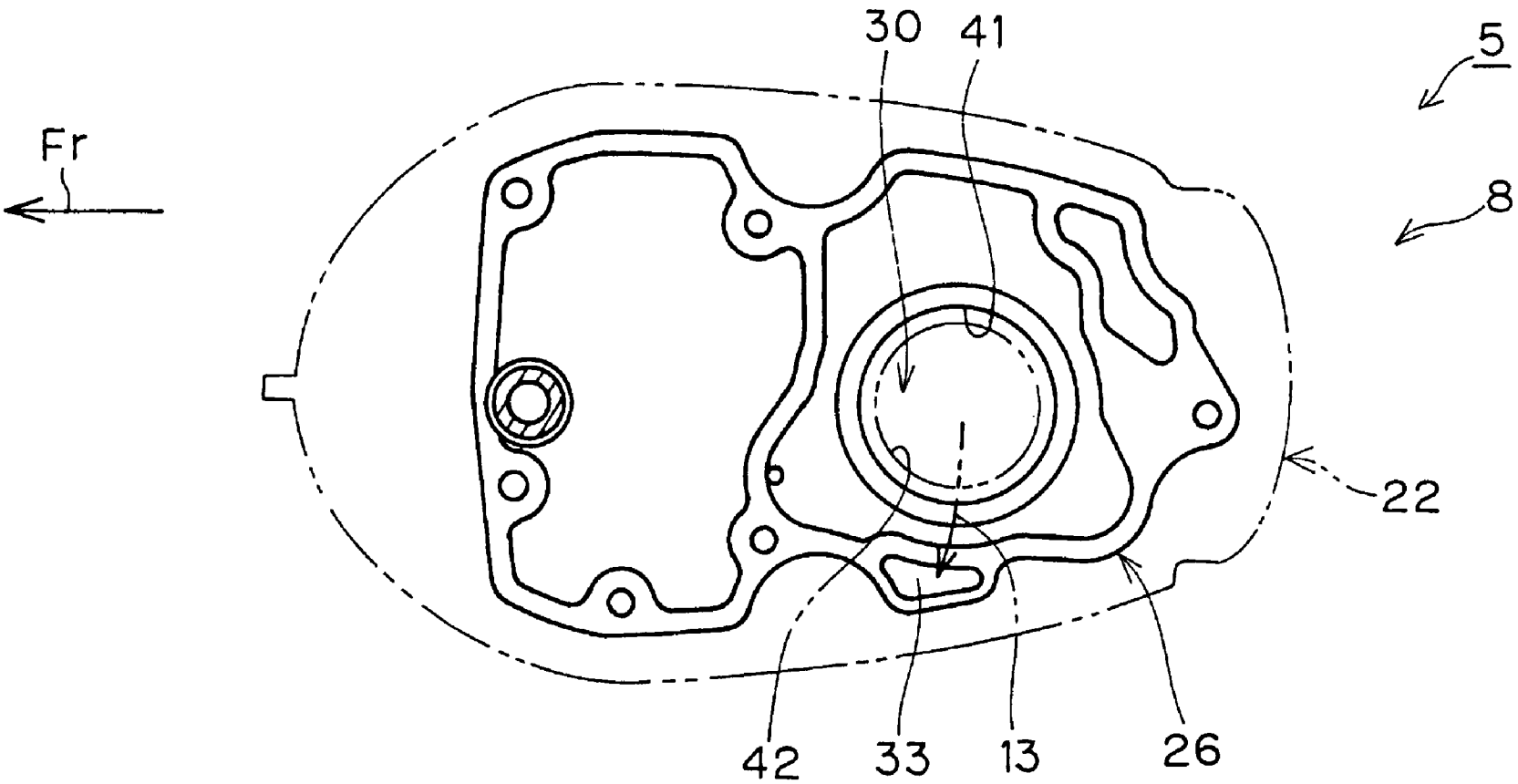
FIG. 8 is a top plan view of a partition plate of the outboard motor of FIG. 2.

With reference to FIGS. 2 and 3, the exhaust guide 18, the oil pan 20, and the partition plate 26 are respectively formed with through-holes 39, 40, 41 (see FIGS. 5, 7 and 8) penetrating vertically therethrough that enable fluid communication between these three components. An exhaust pipe 42, fitted in the through-hole 40 in the oil pan 20 from its lower side, extends downward such that a lower end thereof is fitted in the through-hole 41 in the partition plate 26. Fasteners 19, 43 attach the exhaust pipe 42 to the exhaust guide 18 and the oil pan 20, respectively. The through-hole 39 in the exhaust guide 18, the through-hole 40 in the upper portion of the oil pan 20, and the interior of the exhaust pipe 42 fluidly communicate with each other to form the upstream-side passage 32 of the exhaust passage 30.

Figure 9:
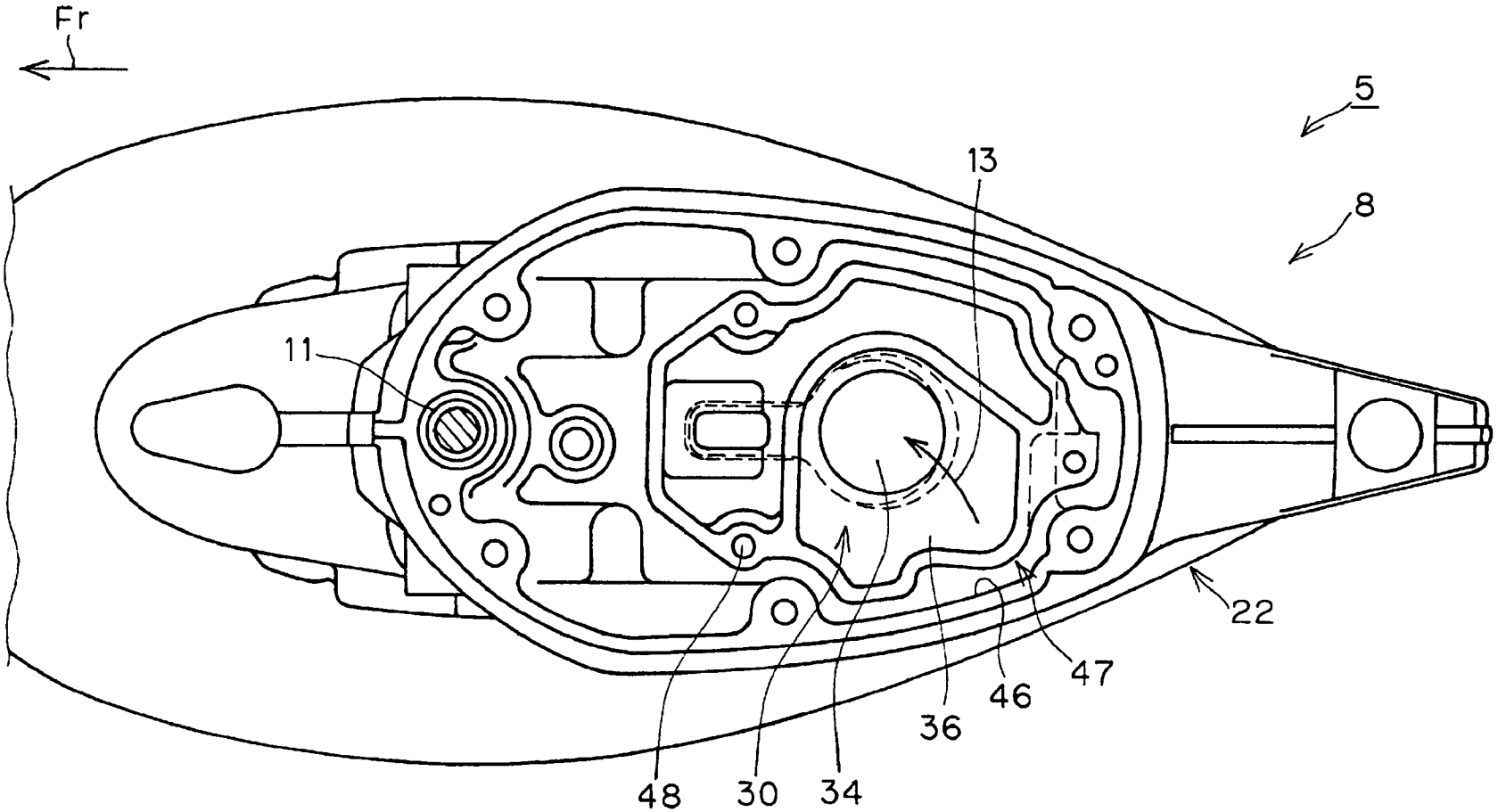
FIG. 9 is a cross-sectional view of a portion of the outboard motor taken along the line 9—9 of FIG. 2.
Figure 10:
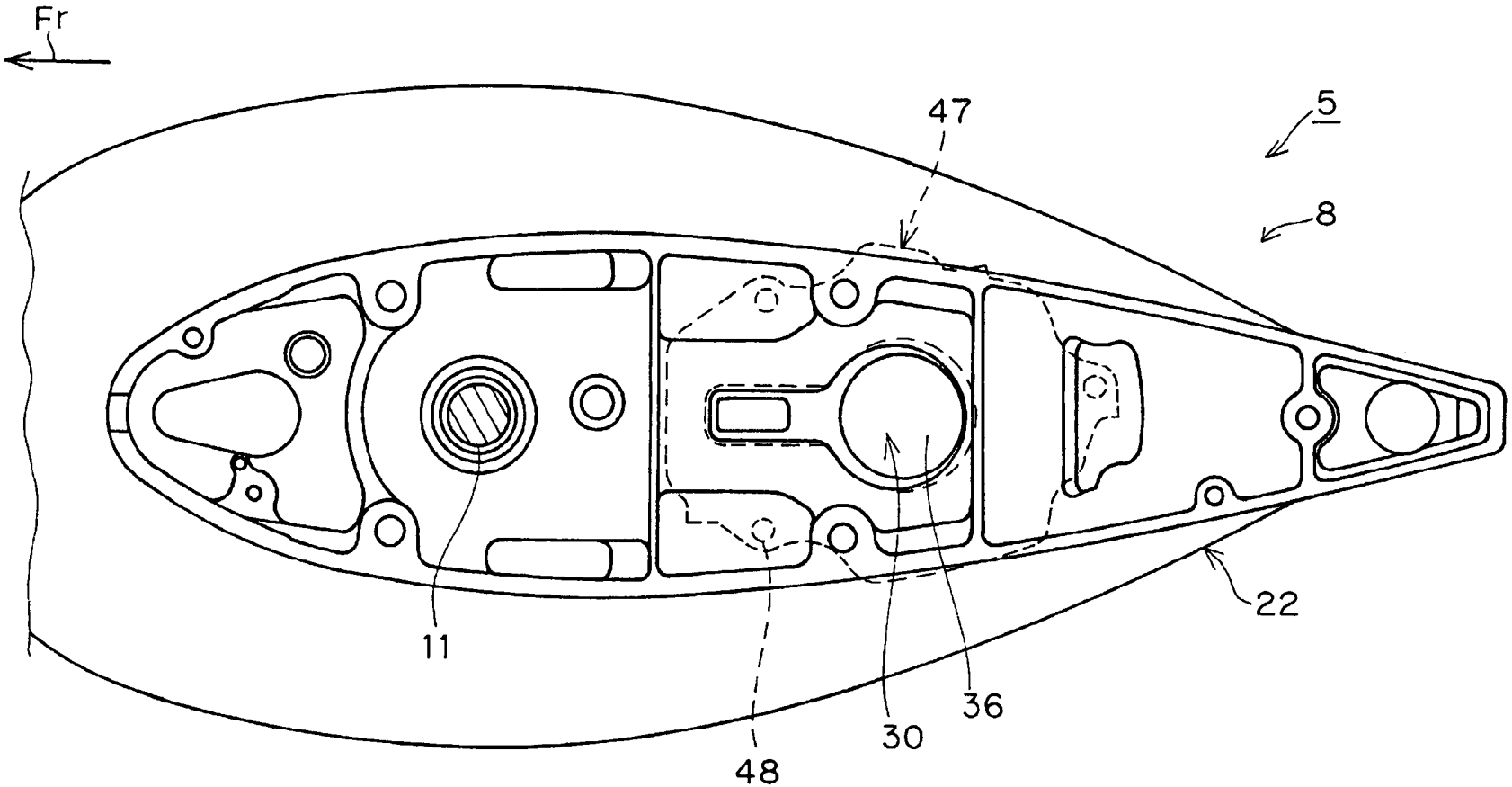
FIG. 10 is a cross-sectional view of a portion of the outboard motor taken along the line 10—10 of FIG. 3.

With reference to FIGS. 2 and 3, a passage 46 extends vertically through the upper case 22. A muffler 47 (see FIGS. 9 and 10) is fitted in the passage 46. Fasteners 21, 48 attach the upper end of the muffler 47 to the oil pan 20 and the partition plate 26. The interior of the muffler 47 defines the expansion chamber 36. The lower end of the upstream-side passage 32 inside the exhaust pipe 42 fluidly communicates with the upper end of the expansion chamber 36 inside the muffler 47. The downstream-side passage 34 of the exhaust passage 30 is formed in the lower case 24. The lower end of the expansion chamber 36 inside the muffler 47 communicates with the upper end of the downstream-side passage 34 inside the lower case 42.

With reference to FIG. 2, portions of the exhaust guide 18 and the oil pan 20 form the expansion chamber 37 of the branch passage 31. The expansion chamber 37 comprises a plurality of expansion chambers, including a first expansion chamber 51, a second expansion chamber 52, a third expansion chamber 53 and a fourth expansion chamber 54. Those of ordinary skill in the art will appreciate that more or fewer expansion chambers could be provided to suit a particular application. The first through fourth expansion chambers 51, 52, 53, 54 are disposed in series from the upstream side to the downstream side of the expansion chamber 37 and are in fluid communication with each other. In the illustrated embodiment, communicating portions between the respective expansion chambers 51, 52, 53, 54 are smaller in cross-section as compared to the expansion chambers themselves.

With continued reference to FIG. 2, the lower portion of the exhaust guide 18 defines the respective upper regions of the first through fourth expansion chambers 51, 52, 53, 54, and the oil pan 20 defines the respective lower regions of the first through fourth expansion chambers 51, 52, 53, 54. The lower region of the first expansion chamber 51 opens downward to a region below the oil pan 20, and the opening at its lower end is partially closed by the partition plate 26. The lower region of the expansion chamber 52 is formed along the upper surface of the oil pan 20. The respective lower regions of the third and fourth expansion chambers 53, 54 extend across generally the entire oil pan 20 in the vertical direction, and each is closed at a bottom end.

With continued reference to FIG. 2, the upstream-side passage 33 of the branch passage 31 is formed in the partition plate 26 and provides fluid communication between the upstream end of the expansion chamber 36 of the exhaust passage 30 and the upstream end of the first expansion chamber 51. The downstream-side passage 35 of the branch passage 31 is formed in the rear surface of the oil pan 20 and provides fluid communication between the fourth expansion chamber 54 and the ambient air.

With continued reference to FIG. 2, an exhaust pipe 56 provides fluid communication between the lower region of the third expansion chamber 53 and the upper region of the fourth expansion chamber 54. The oil pan 20 supports the exhaust pipe 56. The exhaust pipe 56 extends from an upstream end located in the lower region of the third expansion chamber 53 and passes through the upper region of the third expansion chamber 53 to a downstream end that opens to the upper region of the fourth expansion chamber 54, which is outside the third expansion chamber 53. The exhaust pipe 56 forces exhaust gas entering the upper region of the third expansion chamber to travel to the lower region of the third expansion chamber in order to enter the pipe 56. The exhaust pipe 56 thus lengthens the fluid path of the exhaust gases, which reduces exhaust noise.

With continued reference to FIG. 2, another exhaust pipe 57 provides fluid communication between the lower region of the fourth expansion chamber 54 and the ambient air through the downstream-side passage 35. The oil pan 20 supports the exhaust pipe 57. The exhaust pipe 57 extends from an upstream end located in the lower region of the fourth expansion chamber 54 and passes through the upper region of the fourth expansion chamber 54, to a downstream end that opens to the downstream-side passage 35. Thus, the downstream end of the exhaust pipe 57 opens to the ambient air, which is outside the fourth expansion chamber 54, through the downstream-side passage 35. In the same manner as the exhaust pipe 56 described above, the exhaust pipe 57 lengthens the fluid path of the exhaust gases, which reduces exhaust noise.

Figure 4:
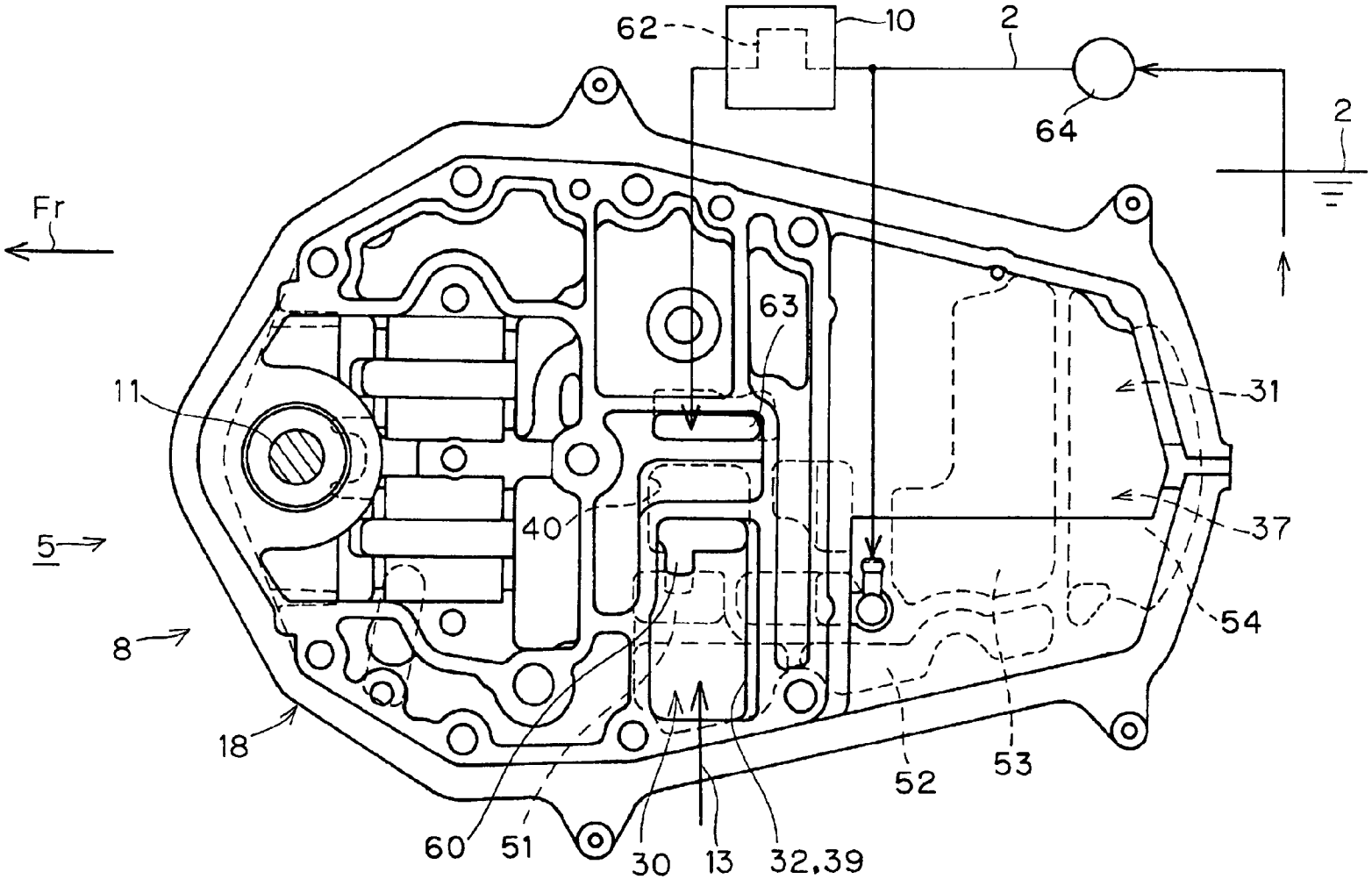
FIG. 4 is a cross-sectional view of a portion of the outboard motor taken along the line 4—4 of FIG. 2.
Figure 5:
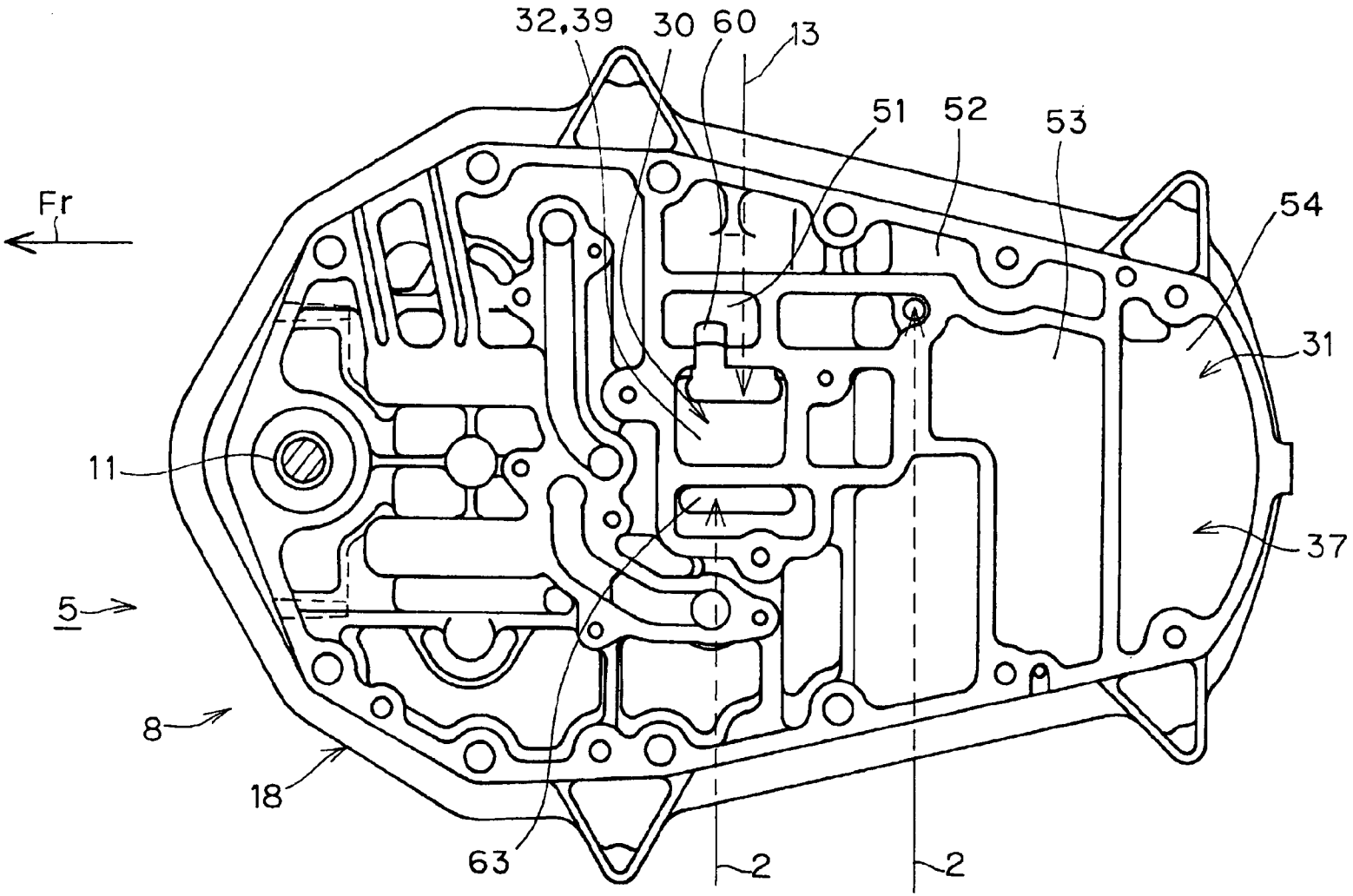
FIG. 5 is a cross-sectional view of a portion of the outboard motor taken along the line 5—5 of FIG. 2.

With reference to FIGS. 4 and 5, a bypass 60 provides fluid communication between the upstream-side passage 32 of the expansion passage 30 and the expansion chamber 37 of the branch passage 31. The bypass 60 is formed in the lower surface of the exhaust guide 18 and allows fluid communication between the upper end of the upstream-side passage 32 and the first expansion chamber 51 of the expansion chamber 37. As explained in detail below, the bypass aids in inhibiting water from being drawn into the internal combustion engine through the exhaust passage.

Figure 6:
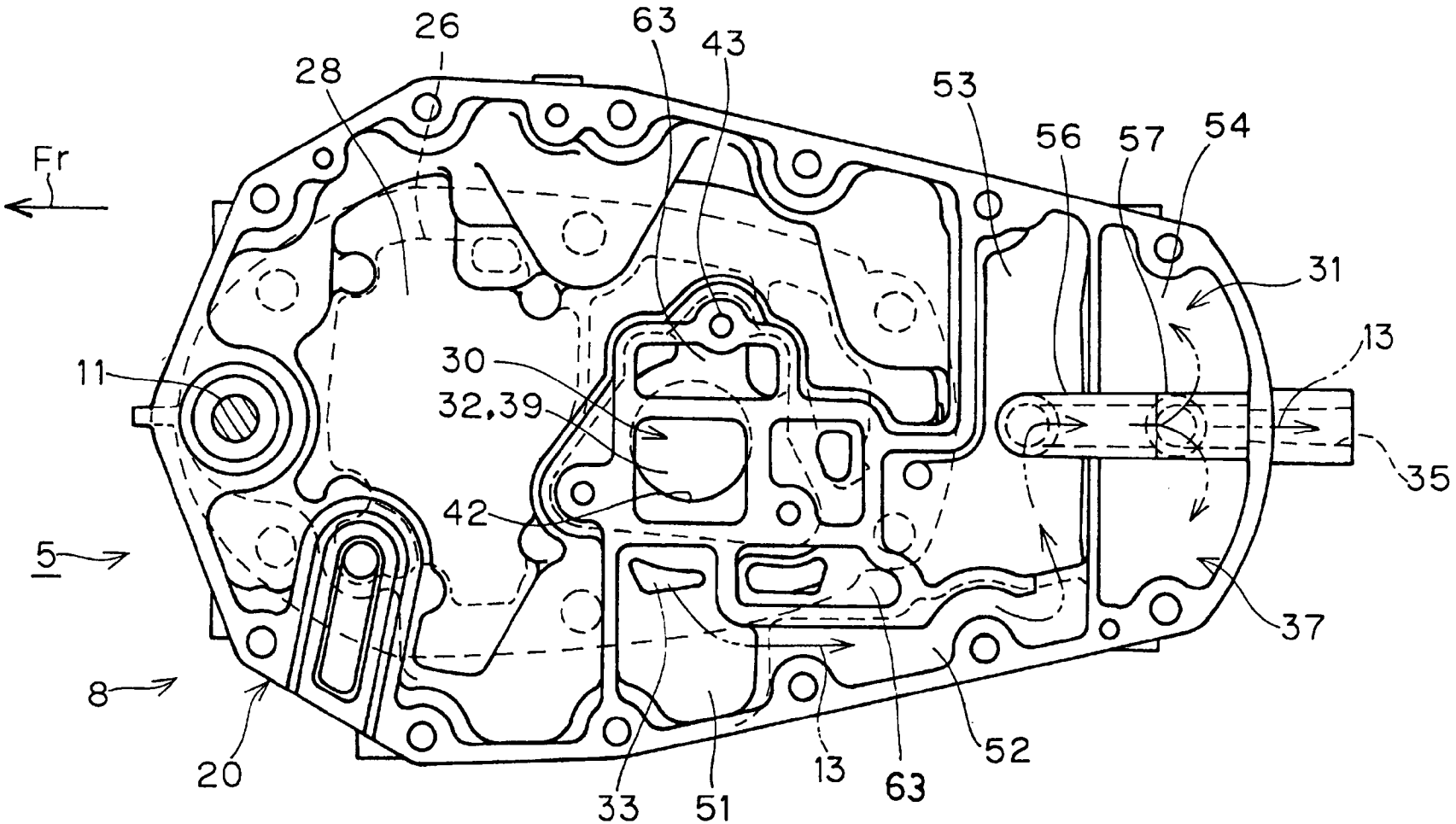
FIG. 6 is a cross-sectional view of a portion of the outboard motor taken along the line 6—6 of FIG. 2.

With reference to FIGS. 4–6, the internal combustion engine 10 includes a coolant passage 62, and the case 8 includes a coolant passage 63 extending along the exhaust passage 30. The internal combustion engine 10 powers a coolant pump 64 via the power transmission device 11. When the coolant pump 64 is driven, a portion of the water 2 is pumped up from the body of the water 2, circulated through the coolant passages 62, 63, and then returned to the body of the water 2. The internal combustion engine 10 and the case 8 are thereby cooled.

With reference to FIG. 1, the internal combustion engine 10 drives the propeller 9, which propels the boat 1. Most of the exhaust gas 13 from the internal combustion engine 10 is discharged into the water 2 through the exhaust passage 30. A portion of the exhaust gas 13 (indicated by the chain of double-dashed lines in FIGS. 2 and 6) passes through the branch passage 31 from an intermediate portion of the exhaust passage 30 to be directly discharged into the ambient air. When the internal combustion engine 10 is idling, the exhaust gas 13 is small in amount and low in pressure. Therefore, most of the exhaust gas 13 from the internal combustion engine 10 which has reached the intermediate portion of the exhaust pipe 30 passes through the branch passage 31 to be directly discharged into the ambient air. At this time, the exhaust gas 13 passes through the respective expansion chambers 36, 37 of the exhaust passage 30 and the branch passage 31, and the exhaust noise is thereby be reduced.

In the expansion chamber 37 of the branch passage 31, the exhaust gas 13 inside the second expansion chamber 52 flows into the upper region of the third chamber 53. The exhaust gas 13 must then flow from the upper region to the lower region of the third expansion chamber 53 so that it can enter the upstream end of the exhaust pipe 56. The exhaust gas 13 then travels to the downstream end of the exhaust pipe 56, and then into the upper region of the fourth expansion chamber 54. The exhaust gas 13 must then flow from the upper region to the lower region of the fourth expansion chamber 54 so that it can enter the upstream end of the exhaust pipe 57. The exhaust gas 13 then flows from the upstream end to the downstream end of the exhaust pipe 57, and is finally discharged into the ambient air. In this manner, the exhaust pipes 56, 57 lengthen the fluid path of the exhaust gas 13, thereby further reducing exhaust noise.

In the above construction, the expansion chamber 37 of the branch passage 31 is formed within both the exhaust guide 18 and the oil pan 20. That is, the expansion chamber 37 of the branch passage 31 is partially defined by the oil pan 20, and partially defined by the exhaust guide 18. Therefore, the capacity of the expansion chamber 37 is increased as compared to the conventional art, in which the expansion chambers are formed only in an upper case (which is a counterpart of the oil pan 20). This increased capacity significantly reduces the exhaust noise generated when the internal combustion engine 10 is idling.

The respective mating surfaces of the exhaust guide 18 and the oil pan 20 preferably form the expansion chamber 37. Therefore, specifically when the exhaust guide 18 and the oil pan 20 are made by casting, dies can be easily removed when forming the expansion chamber 37. The branch passage 31 can thus be formed easily and inexpensively.

As described above, the exhaust pipes 56, 57 include upstream ends that are located in the lower region of the expansion chamber 37 and that pass through the upper region of the expansion chamber 37 with their downstream ends opening outwardly therefrom. Thus, the exhaust gas 13 from the exhaust passage 30 flows in the expansion chamber 37 from its upper region to its lower region and then flows in the exhaust pipes 56, 57 from their upstream ends to their downstream ends. This configuration increases the length of the path that the exhaust gas must follow through the expansion chamber 37 and takes advantage of the fact that the case 8 has a greater vertical dimension than horizontal dimension. Further, by forming the expansion chamber 37 in such a manner as to extend across the exhaust guide 18 and the oil pan 20, the expansion chamber 37 can be made even longer. The increased length and size of the expansion chamber 37 through which the exhaust gas 13 flows significantly reduces exhaust noise.

Also, as described above, the bypass 60 allows the upstream-side passage 32, which is a portion of the expansion passage 30 upstream from the expansion chamber 37, to communicate with the expansion chamber 37 of the branch passage 31. When the internal combustion engine 10 is started or reversed, the pressure in the upstream-side passage 32 of the exhaust passage 30 tends to be negative (relative to ambient pressure). When the pressure in the upstream-side passage 32 is about to become negative, however, the upstream-side passage 32 draws in ambient air through the branch passage 31 and air (and/or exhaust gas 13) through the bypass 60 from the large-volume expansion chamber 37 of the branch passage 31. Therefore, the pressure in the exhaust passage 30 is unlikely to become excessively negative when the internal combustion engine 10 is started or reversed. As a result, water 2 is unlikely to be drawn into the internal combustion engine 10 through the exhaust passage 30 when the internal combustion engine 10 is started or reversed.

Forming the expansion chamber between both the exhaust guide and the oil pan can increase the size of the expansion chamber, thereby reducing exhaust noise. In certain embodiments, the case further includes at least one exhaust pipe that increases the length of a path of travel of the exhaust gases through the branch passage, thereby further reducing exhaust noise. In certain other embodiments, the case further includes a bypass. formed in the exhaust guide. The bypass allows a portion of the exhaust passage upstream from the branch passage to communicate with the expansion chamber, thereby lessening the likelihood that cooling water will be drawn into the exhaust passage. The present exhaust system thus sufficiently reduces exhaust noise generated when an internal combustion engine of an outboard motor is idling while also inhibiting water from being drawn toward the internal combustion engine through the exhaust passage when the internal combustion engine is started or stopped. While in a preferred form, the exhaust system accomplishes both of these aspects, the construction of the idle-exhaust expansion chamber can be practiced apart from the bypass, and vise versa. Similarly, the use of the exhaust pipe to lengthen the branch passages can be practiced apart from the construction of the idle-exhaust expansion chamber. Additionally, those of ordinary skill in the art will also appreciate that several alternative constructions to those provided above are contemplated and within the scope of the claims that follow. For example, the first through fourth expansion chambers 51, 52, 53, 54 may be reduced in number to three or less. Additionally or alternatively, the exhaust pipes 56, 57 may not be provided.

The above presents a description of the best mode contemplated for carrying out the present exhaust system, and of the manner and process of making and using it, in such full, clear, concise, and exact terms as to enable any person skilled in the art to which it pertains to make and use this exhaust system. This exhaust system is, however, susceptible to modifications and alternate constructions from that discussed above that are fully equivalent. Consequently, this exhaust system is not limited to the particular embodiments disclosed. On the contrary, this exhaust system covers all modifications and alternate constructions coming within the spirit and scope of the exhaust system as generally expressed by the claims, which particularly point out and distinctly claim the subject matter of the exhaust system.

What is claimed is:

1. An outboard motor for a watercraft, the outboard motor comprising:

an internal combustion engine;

a drive unit being configured to be supported by a hull of the watercraft and having an exhaust guide that forms an upper portion of the drive unit, the exhaust guide having an upper surface and a lower surface, the upper surface supporting the engine;

an oil pan attached to the lower surface of the exhaust guide; and an exhaust system disposed within the drive unit and being comprised of:

an exhaust passage configured to lead exhaust gas from the upper portion of the drive unit to a discharge end, the discharge end being disposed on the outboard motor so as to expel the exhaust gas into a body of water on which the watercraft is operated under at least some operating conditions of the outboard motor; and a branch passage extending from the exhaust passage at an intermediate portion thereof, the intermediate portion being disposed between the upper portion of the drive unit and the discharge end, the branch passage being configured to discharge the exhaust gas inside the exhaust passage to the ambient air, the branch passage being formed with an expansion chamber, the expansion chamber being at least partially defined between a portion of the exhaust guide and a portion of the oil pan; and wherein the branch passage further comprises an exhaust pipe, an upstream end of the exhaust pipe being located in a lower region of the expansion chamber, the exhaust pipe passing through an upper region of the expansion chamber and having a downstream end opening outside the expansion chamber.

2. The outboard motor of claim 1, wherein an upstream section of the branch passage opens into the expansion chamber at an upper region of the expansion chamber, such that exhaust gas from the exhaust passage flows into the expansion chamber at the upper region thereof, then to the lower region of the expansion chamber, and then flows into the exhaust pipe.

3. The outboard motor of claim 2, wherein the exhaust guide further comprising a bypass extending between an exhaust passage within the exhaust guide and the expansion chamber, the bypass allowing a portion of the exhaust passage upstream from the branch passage to communicate with the expansion chamber.

4. The outboard motor of claim 1, wherein an upstream section of the branch passage opens into the expansion chamber at an upper region of the expansion chamber.

5. The outboard motor of claim 1, wherein the exhaust guide further comprising a bypass extending between an exhaust passage within the exhaust guide and the expansion chamber, the bypass allowing a portion of the exhaust passage upstream from the branch passage to communicate with the expansion chamber.

6. The outboard motor of claim 1 additionally comprising a bypass passage that communicates with the expansion chamber and with the exhaust system so as to place the exhaust system in fluidic communication with the expansion chamber independent of the branch passage.

7. An outboard motor comprising an exhaust guide, an engine mounted at least partially atop of the exhaust guide, an oil pan attached to the exhaust guide, a primary exhaust passage communicating with the engine through the exhaust guide, and a branch passage extending from the primary exhaust passage, the branch passage including at least one expansion chambers, wherein a lower portion of the exhaust guide defines at least a first portion of the expansion chamber, and an upper portion of the oil pan defines at least a second portion of the expansion chamber.

8. The outboard motor of claim 7 additionally comprising a bypass passage that communicates with the expansion chamber and with the primary exhaust passage so as to place the primary exhaust passage in fluidic communication with the expansion chamber independent of a section of branch passage upstream of the expansion chamber.

9. The outboard motor of claim 8, wherein the bypass passage is formed in part by an exhaust pipe disposed downstream of the expansion chamber, and an inlet end of the exhaust pipe being disposed in a lower portion of the expansion chamber with the exhaust pipe extending upwardly from the inlet end.

10. The outboard motor of claim 7, wherein a lower portion of the exhaust guide defines at least a second portion of the expansion chamber.

* * * * *